United States Patent [19]

Lohausen

[11] Patent Number: 4,753,280

[45] Date of Patent: Jun. 28, 1988

[54] MOUNTING DEVICE AND BEARING CAP FOR A SHAFT CARRYING WOUND-UP MATERIAL

[76] Inventor: Viktor Lohausen, Goldmühlestrassse 99/2, D-7032 Sindelfingen, Fed. Rep. of Germany

[21] Appl. No.: 838,274

[22] Filed: Mar. 10, 1986

[30] Foreign Application Priority Data

Mar. 11, 1985 [CH] Switzerland ..... 1076/85

[51] Int. Cl.[4] ..... E04F 10/00

[52] U.S. Cl. ..... 160/22; 160/26

[58] Field of Search ..... 160/22, 26, 67, 68, 160/70, 78

[56] References Cited

U.S. PATENT DOCUMENTS

| | | | |
|---|---|---|---|
| 1,390,527 | 9/1921 | Gray | 160/22 |
| 1,413,596 | 4/1922 | Langdon | 160/22 X |
| 2,679,289 | 5/1954 | Loos | 160/22 |
| 4,469,159 | 9/1984 | Lohausen | 160/22 |
| 4,566,516 | 1/1986 | Lohausen | 160/22 |

FOREIGN PATENT DOCUMENTS

| | | | |
|---|---|---|---|
| 2359132 | 6/1975 | Fed. Rep. of Germany . | |
| 2817759 | 11/1978 | Fed. Rep. of Germany . | |
| 2916496 | 11/1979 | Fed. Rep. of Germany . | |
| 3015990 | 11/1981 | Fed. Rep. of Germany | 160/22 |
| 2514941 | 6/1984 | Fed. Rep. of Germany . | |
| 3206963 | 10/1984 | Fed. Rep. of Germany . | |
| 7141266 | 7/1973 | France . | |
| 456916 | 7/1968 | Switzerland . | |
| 834097 | 5/1960 | United Kingdom . | |

*Primary Examiner*—Ramon S. Britts
*Assistant Examiner*—Sarah A. Lechok Eley
*Attorney, Agent, or Firm*—Ostrolenk, Faber, Gerb & Soffen

[57] ABSTRACT

An awning assembly comprising an awning canopy rolled onto a roller spindle has two end caps which provide bearing support for the roller spindle and serve as hinge members which are pivotally attached to support brackets mounted on a supporting surface. Each end cap is provided with at least one bore extending parallel to the axis of the roller spindle and/or at least one bore extending laterally in a plane perpendicular to the axis of the roller spindle for the reception of a pivot pin. Each support bracket is provided with a pivot pin aperture which is capable of receiving the pivot pin, to thereby provide a hinged connection between the end cap and the support bracket. This enables a first part of the awning assembly to be raised and held in position by means of a hinged connection before a second part of the awning assembly is raised into its final position by rotating the awning assembly about the hinged connection.

17 Claims, 5 Drawing Sheets

MOUNTING DEVICE AND BEARING CAP FOR A SHAFT CARRYING WOUND-UP MATERIAL

FIELD OF THE INVENTION

The invention relates to a roller screen and, in particular, to a roller screen comprising a sheet of pliable material, a roller spindle onto which the sheet of pliable material can be rolled, and mounting means formed so as to facilitate mounting of the roller screen on a support surface.

The roller screen may comprise a protective enclosure with end-caps which form part of the mounting means and provide bearing support for opposite ends of the roller spindle. Articulated arms may be mounted within the protective enclosure for extension out of the protective enclosure to support the sheet of pliable material when it is unwound from the roller spindle. The sheet of pliable material may constitute the canopy of an awning, a projection screen, a light shade, or a map or similar display.

BACKGROUND OF THE INVENTION

No. DE-A-25 14 941 discloses a roller screen comprising a screen assembly which has a protective enclosure of self-supporting construction and which is clasped by two pairs of holding jaws. Articulated arms are pivotally mounted on the opposite ends of the enclosure and on two wall brackets respectively spaced from the opposite ends of the enclosure. A shaft carrying a screen in the form of an awning canopy is mounted in hinge members which are attached to the two wall brackets to support the weight of the canopy when the canopy is rolled onto the shaft. The end regions of the enclosure (outside the two wall brackets) are therefore subject to flexure. The enclosure is therefore provided with a stiffening profile and, particularly in the case of very wide awnings, must have relatively thick walls. The assembly is therefore quite heavy and difficult to handle during mounting.

This deficiency is to some extent reduced in the screen assembly of the roller screen disclosed in No. GB-A No. 834 097 because here the intention is to accommodate the screen assembly in depressions in a supporting wall, the screen assembly being supported over its entire length by the lower edge of such a wall depression. However, by virtue of this form of mounting, the range of applicability of this assembly is distinctly curtailed.

In general, however, in the mounting of screen assemblies of roller screens such as that disclosed in No. DE-A No. 29 16 496, the mounting means include brackets which are fastened to a supporting surface such as a wall or ceiling. The screen assembly, which is produced as a mounting unit, is then mounted on or attached to the brackets. A longitudinally extending supporting element, such as a mounting tube, is often provided and this is connected to the brackets.

Screen assemblies such as awning assemblies in cooperating wide awning canopies are quite heavy, particularly when the awning assembly is provided with articulated awning arms which, in the retracted condition, are accommodated within a protective enclosure forming part of the awning assembly. These awning arms must be strong enough to support the awning in strong, gusting wind and add considerably to the weight of the awning assembly. Due to the high weight, two fitters are usually required for mounting the awning assembly on a support surface.

Awning assemblies of roller awnings are usually provided with a mounting tube which, when the roller awning is mounted on a support surface, is disposed on the underside of the awning assembly. Therefore, when it is necessary to lift an awning assembly which is lying on the ground with the mounting tube underneath, and to mount the awning assembly in an overhead position, the awning assembly must be grasped from above. It is therefore normal for the fitters to grasp the mounting tube and the top bar which is attached to the outer end of the awning canopy. However, this causes difficulty when the awning assembly has to be lifted above head height because, in this process, the hand grip must be changed. In addition, the drop bar (which is normally relatively thin) can be bent. In many cases, the awning assembly is therefore placed on the ground with the mounting tube uppermost, instead of in its normal lower position, so that the awning assembly may be more easily gripped and lifted by the mounting tube. Unfortunately, when lifting an awning assembly in this way, there is a tendency for the fitters to tilt or roll the awning assembly as it is lifted from the ground and so the rolled canopy, which is then nearest to the ground, can be soiled or even damaged.

These problems naturally do not occur with light weight awning assemblies. If the canopy is rolled onto a spring roller in the same way as a window blind and extends only over the width of a narrow window, as in the roller awning disclosed in U.S. Pat. No. 1,788,173, a single fitter can lift the entire awning assembly in both hands and mount it in an overhead position without any trouble.

OBJECT AND SUMMARY OF THE INVENTION

It is an object of the present. invention to provide a roller screen with a screen assembly having mounting means which so facilitate the mounting of the screen assembly as to enable even quite heavy screen assemblies to be mounted by only one person.

This object is achieved in accordance with the invention by providing a roller screen with a screen assembly comprising a sheet of pliable material, a roller spindle on which the sheet of pliable material can be rolled, and at least one hinge member supporting the roller spindle. The roller screen is also provided with first pivot means which are supported by the hinge member and extend along at least one of two rectilinear axes respectively extending parallel to the roller spindle and laterally in a plane which is perpendicular to the roller spindle. It is then possible to attach a support bracket to a support surface on which the roller screen is to be mounted so that the first pivot means co-operate with second pivot means formed in the support bracket so as to permit pivotal movement between the hinge member and the support bracket.

In preferred embodiments of the invention, one or more bores are formed in the hinge member along at least one of the two rectilinear axes, the first pivot means comprise a pivot pin which extends through at least one of those bores, and the second pivot means comprise a pivot pin aperture for receiving and supporting the pivot pin so that the hinge member and support bracket are hingedly connected.

The screen assembly can then be lifted into proximity with the support bracket and arranged so that at least one of the bores formed in the hinge member is axially aligned with the pivot pin aperture formed in the support bracket. The pivot pin can then be inserted in said bore and in the pivot pin aperture to hingedly connect the hinge member to the support bracket.

The mounting of the screen assembly of a roller screen in which the rectilinear axes extend laterally in a plane perpendicular to the roller spindle is substantially simplified, particularly where the rectilinear axis extends horizontally. In this case, only one end of the screen assembly need be raised to connect the hinge member to the support bracket. The other end may simply be rested on the ground or on a ladder or some other convenient temporary support. The other end of the screen assembly can then be raised by rotating the screen assembly about the rectilinear axis through the first and second pivot means, prior to fastening the screen assembly in place. If necessary, this can normally be accomplished by a single fitter. Clearly, it is preferred that this rectilinear axis extends horizontally, although mounting is also facilitated when the rectilinear axis extends laterally at an angle to the horizontal.

The mounting of the roller screen can also be facilitated by providing the roller screen with two support brackets and with a screen assembly having two longitudinally spaced hinge members. In this case, when one of the hinge members has been hingedly connected to one of the support brackets as hereinbefore described, the screen assembly can be fastened in place by hingedly connecting the other hinge member to the other support bracket, in analogous manner.

The use of such preferred embodiments of the invention comprising two support brackets and a screen assembly having two hinge members is particularly useful where the rectilinear axis in each hinge member extends parallel to the roller spindle because, in this case, these two rectilinear axes can be colinearly aligned. This means that although both ends of the screen assembly must be lifted together, to align the two rectilinear axes with the second pivot means in the two support brackets, the rotational orientation of the screen assembly about the two rectilinear axes is irrelevant and this simplifies the mounting process making it easier for a single fitter to effect the mounting.

The screen assembly is simply held horizontally and raised until the rectilinear axes formed in the two hinge members are aligned with the second pivot means of the two support brackets. The first and second pivot means at both ends of screen assembly are then engaged, one at a time, to hingedly connect the two hinge members to the respective support brackets.

It is also preferred that the hinge member or each of the hinge members is formed as an end cap which provides bearing support for one end of the roller spindle. An end cap such as this may form part of a protective enclosure which, itself, forms part of the screen assembly. This form of construction corresponds, in some respects, with the construction disclosed in U.S. Pat. No. 1,788,173. However, as hereinbefore disclosed, this prior art design is of such light weight construction that the problems of lifting heavy weights do not arise. Each of the end caps according to the present invention is formed with at least one substantially straight external edge extending along an edge axis lying in a plane which is perpendicular to the axis of the roller spindle and with a reinforcing rib extending longitudinally along said axis. In this case, the two rectilinear axes extend, respectively, along and transversely of the reinforcing rib.

Where the first pivot means in each end cap comprise a pivot pin, formation of the bore or each bore along one or both rectilinear axes in the vicinity of a substantially straight external edge of the end cap significantly simplifies connection of the end cap to a support bracket.

In constructions in which there are two hinge members in the form of end caps at opposite ends of a protective enclosure, and in which the sheet of pliable material constitutes the canopy of an awning, the protective enclosure may include a mounting tube extending parallel to the roller spindle and at least two articulated arms may be fastened to the mounting tube within the protective enclosure so as to be extensible from within the protective enclosure for supporting the awning canopy when it is unrolled from the roller spindle. At least one of the end caps may be formed with a reinforcing rib which constitutes a support for one end of the mounting tube.

This configuration yields a number of advantages:

each end cap is stiffened by at least one reinforcing rib so that although the end cap provides bearing support for one end of the roller spindle and may provide support for one end of the mounting tube, as well as constituting an end closure for the protective enclosure, it can be of relatively light construction, resulting in a saving in weight;

at the same time, the reinforcing rib which extends perpendicular to the axis of the roller spindle is formed with at least one bore for receiving a pivot pin for hingedly connecting the screen assembly to a support bracket and if this bore in the end cap at one end of the screen assembly extends perpendicular to the roller spindle, only this end of the screen assembly need be raised initially and hingedly connected to a support bracket. The other end can be rested on the ground or on some other support during this operation and then lifted into position by rotating the screen assembly about the axis of the pivot pin at said one end of the screen assembly;

the formation of a substantially straight external edge extending perpendicular to the roller spindle on each end cap is consistent with the provision a relatively flat, compact screen assembly which is relatively easy to handle. This is particularly advantageous where the protective enclosure accommodates articulated arms for supporting an awning canopy. Each end cap may be formed with lateral dimensions which exceed the lateral extent of the articulated arms when the articulated arms are in their retracted condition within the protective enclosure so as to ensure that during mounting of the screen assembly the end cap provides protection for the articulated arms in longitudinal and lateral directions.

The designation of the external edge with which the end cap is preferably formed as "substantially straight" is simply to indicate that the advantages obtained by the provision of a rectilinear external edge are not lost if this external edge is slightly curved or rounded at one or more places. In any case, the external edge extends along an edge axis and reinforcing rib extends along this edge axis and is formed with one or more bores extending on at least one of two rectilinear axes extending laterally of the reinforcing rib, parallel to the roller spindle, or along the reinforcing rib to receive a pivot pin for hingedly connecting the end cap to a support bracket.

The pivot pin can be hollow or solid and it can be formed with or without a screw thread to hold it in place. It can also be provided with other means, such as a locking pin, a cotter pin or a set screw for holding it in place.

According to a further embodiment of the invention, the end cap of the roller screen has adjacent portions formed with a substantially straight external edge, as hereinbefore described, as well as with at least one further substantially straight external edge which extends along the edge axis, and a cavity formed in the end cap between at least one pair of adjacent portions. The support bracket is provided with at least one connecting lug which extends into the cavity and the pivot pin aperture extends through the connecting lug. The pivot pin extends through said adjacent portions and said connecting lug along a rectilinear axis which is parallel to the edge axis. Preferably, each connecting lug comprises at least one arm and a sleeve supported by the arm, the sleeve having a bore constituting at least part of the pivot pin aperture. The end cap is preferably formed with a plurality of concavities which each accommodate a sleeve which is attached to the base of a single support bracket by at least one arm.

The support bracket may constitute a fitting to be attached to a support surface for the roller screen or it may constitute a carrying or lifting bracket such as a handle or form part of a carriage or pulley block.

For mounting the screen assembly of such a roller screen, a first support bracket provided with at least one connecting lug is attached to a support surface and a second support bracket attached to the end cap at a first end of the screen assembly is used to raise this end of the screen assembly into co-operative relationship with the first support bracket such that each connecting lug of the first support bracket is received in a concavity formed in the end cap. The pivot pin is then inserted to pivotally connect this end of the screen assembly to the first support bracket. The second end of the screen assembly can be raised by rotating the screen assembly about this pivotal connection and then it is so secured in position.

When the screen assembly is long enough to have the first end lifted into position while pivoting around its second end, which initially remains on the ground, the screen assembly should be laid on the ground with the first end displaced to one side of the first support bracket so as to allow it to swing into its final position along an arcuate path. Sometimes this is overlooked and sometimes it is impossible to position the screen assembly correctly because there is not enough room, because ladders or other equipment are in the way, or because work associated with the mounting of the roller screen, such as the drilling of holes, could soil the screen material if the screen assembly were positioned correctly. In this case, the second end of the screen assembly which initially remains on the ground is dragged along the ground and can be soiled or damaged. For this reason, the second end of the screen assembly is preferably provided with a carriage having wheels, rollers or skids. Where the second end of the screen assembly is provided with an end cap similar to that provided at the first end, the carriage for the second end of the screen assembly may incorporate a support bracket as hereinbefore described.

Where the end cap at the first end of the screen assembly is formed with substantially straight external edges which extend along two edge axes and each concavity formed for receiving a connecting lug of the first support bracket is formed between adjacent portions of the end cap whose substantially straight external edges extend along one of this two edge axes, at least one similarly formed cavity may be formed between adjacent portions of the end cap whose substantially straight external edges extend along the other of these two edge axes. In this case, a second support bracket may be attached to the end cap at the first end of the screen assembly for lifting and transporting the screen assembly.

Where the roller screens have to be carried long distances to their mounting position or these roller screens are of heavy construction, it is expedient to provide both ends of the screen assembly with support brackets for lifting or transporting the screen assembly. Preferably, the support bracket at one end of the screen assembly forms part of a carriage, to facilitate transport of the screen assembly, while the support bracket at the other end of the screen assembly constitutes part of a handle or part of a pulley block.

It is also expedient to form at least one end cap with a reinforcing rib which constitutes a support for one end of a load-bearing element such as a mounting tube or rail extending across the width of the roller screen. The support may comprise a socket having an internal cross-section conforming to the external cross-section of the load-bearing element and, when this load-bearing element is hollow (as in the case of a mounting tube) or is formed with an axially extending cavity in at least one end, the support may also be formed with a projection for engagement within the load-bearing element. The load-bearing element may be used to support components of the screen assembly or merely to ensure that the protective enclosure forming part of the screen assembly is of self-supporting, box-like construction. Thus, when the roller screen is an awning and the sheet of pliable material is an awning canopy, at least two articulated arms may be fastened to the load-bearing element so as to support the awning canopy when it is unwound from the roller spindle. The load-bearing element therefore supports the drop arm of the awning canopy as well as the articulated arms, because the articulated arms must be connected to the drop arm. In an alternative form of construction, where the screen assembly is formed with hinge members which do not constitute end caps, the hinge members can be attached to the load-bearing element. This attachment may be effected, for example, by means of a sliding connection.

Where at least one hinge member is formed as an end cap, as hereinbefore described, this end cap may comprise first gear means for assisting in rolling the sheet of pliable material onto and off the roller spindle. In this case, the output shaft of the first gear means can also serve as a support for the roller spindle and, for this purpose, it is expidient to provide a square-section axial projection on the output shaft of the first gear means or on the roller spindle and a square-section axially extending cavity for receiving this projection on the other of these two components. Alternatively, the first gear means can be provided with an output gear wheel which is rigidly attached to the roller spindle. This results in a reduction in the longitudinal dimensions of the screen assembly which can be of significance in the case of confined mounting conditions, e.g. between the inside surfaces of a wall opening.

Further components of a screen assembly can be arranged in the end cap. This applies regardless of whether the screen assembly is an awning assembly, a projection screen assembly, or some other assembly incorporating a screen which can be rolled on and off a roller spindle. Examples of such components are:

a tie element connected to end caps at opposite ends of the screen assembly and extending through the roller spindle or the mounting tube and screw-threaded tensioning means engaging at least one of the end caps;

where at least two articulated arms are fastened to a mounting tube within the screen assembly for supporting the pliable material when it is unrolled from the roller spindle, second gear means and adjustment means driven by the second gear means for limiting the angle of tilt of one of the articulated arms;

an auxiliary drive element, e.g. a spring, similar to the roller spindle spring shown in U.S. Pat. No. 1,788,173, to assist in rolling the sheet of pliable material onto the roller spindle or, where the screen assembly is an awning assembly, for rolling up and down a frill suspended from the drop rod;

a safety belt that allows the drop rod to be lowered gradually from the protective enclosure, but prevents the drop rod from dropping abruptly or inadvertently, e.g. as a result of strong gusts of wind or damage to the articulated arms.

If the end cap is not large enough to accommodate all of these components, part of one or more of these components can be formed integral with the end cap. For example, in screen assemblies such as this, at least one of the first and second gear means is enclosed by a housing and this housing has a first part formed integral with the end cap and a second part which is removably attached to the first part of the housing.

BRIEF DESCRIPTION OF THE DRAWINGS

Preferred examplary embodiments of the invention are hereinafter described with reference to the drawings, in which.

DETAILED DESCRIPTION OF EMBODIMENTS OF THE INVENTION

Figure 1:
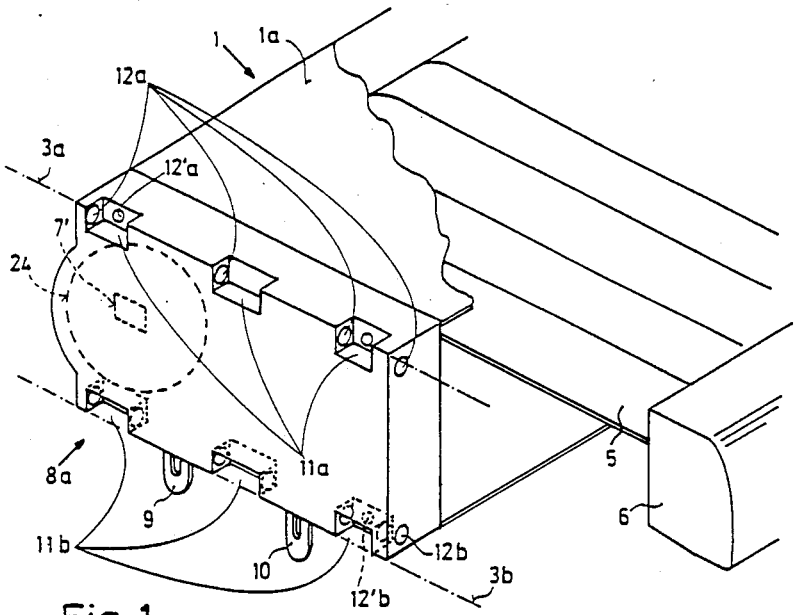
FIG. 1 is a perspective view of the left end of a screen assembly forming part of a roller screen according to a first embodiment of the invention.

As shown in FIG. 1, a screen assembly in the form of an awning assembly 1 has a protective enclosure 1*a*, which is shown cut away at the top the awning assembly 1. The left end of the protective enclosure 1*a* is closed off by an end cap 8*a* which provides bearing support for the left end of the roller spindle 24. The rear wall of the protective enclosure 1*a* is formed with a convexity which extends along the entire length of the awning assembly 1 and, in cross-section, is the shape of a circular segment which conforms to the cross-sectional shape of the roller spindle 24. However, the protective enclosure 1*a* can also have other cross-sectional shapes. Alternatively, the protective enclosure can be of one-piece construction or of open design.

Figure 2:
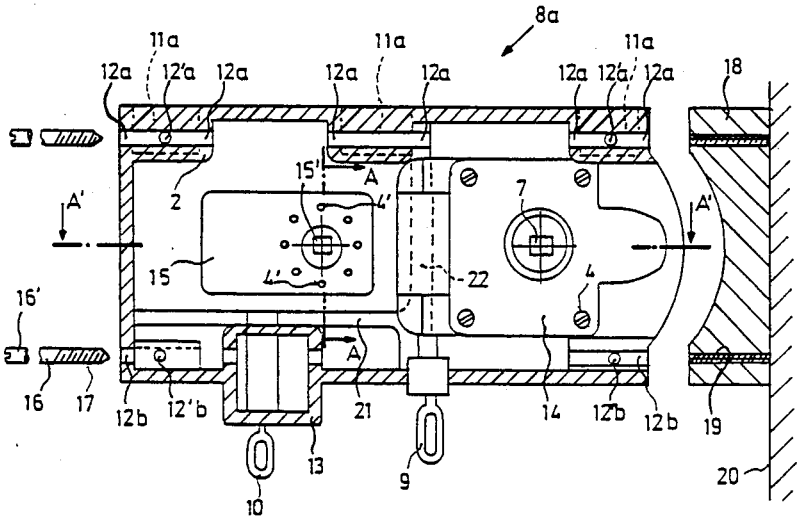
FIG. 2 is a sectional end elevation of the roller screen according to the first embodiment of the invention.

As shown in FIG. 2, a support bracket 18 is attached to a support surface 20 by conventional means (not shown) and has an external surface, facing the end cap 8*a*, which conforms to the rear wall of the end cap 8*a*. The end cap 8*a* is attached to the support bracket 18 by means of two pivot pins 16 which extend respectively through bores 12*a*, 12*b* formed in the end cap 8*a* along first rectilinear axes extending in a plane perpendicular to the axis of the roller spindle 24.

Screw thread portions 17 on the pivot pins 16 engage with internally screw-threaded apertures 19 in the support bracket 18 for mounting the awning assembly as hereinafter described with reference to FIG. 4. Bores 12'*a* and 12'*b* are also formed in the end cap 8*a* along second rectilinear axes extending parallel to the axis of the roller spindle 24 for mounting the awning assembly as hereinafter described with reference to FIG. 5. As indicated in FIG. 3, end cap 8*b* at the right end of the awning assembly is formed for mounting in an analogous manner.

One end of an awning canopy 5 is fastened to the roller spindle 24, the other end to a drop rod 6. Two articulated arms 35 (one of which is shown in FIG. 3) are fastened at one end to a load-bearing element in the form of a mounting tube 34 within the protective enclosure 1*a* by means of a tiltable hinge joint (not shown). The other end of each articulated arm 35 is fastened to the drop rod 6.

As shown in FIG. 1, the end cap 8*a* has four straight external edges extending along a first edge axis 3*a* and four straight external edges extending along a second edge axis 3*b*. The first and second edge axes 3*a* and 3*b* both lie in a plane which is perpendicular to the axis of the roller spindle 24 and reinforcing ribs 2 are formed inside the end cap 8*a* and extend longitudinally along the first and second edge axes 3*a* and 3*b*. Three concavities 11*a* are formed in the end cap 8*a* between adjacent pairs of end cap portions which are formed with the straight external edges extending along the edge axis 3*a*. Similarly, three concavities 11*b* are formed between adjacent pairs of end cap portions which are formed with the straight external edges extending along the edge axis 3*b*. As shown, the first rectilinear axes of the bores 12*a* and 12*b* pass through each of these concavities 11*a* and 11*b* whereas the second rectilinear axes of the bores 12'*a* and 12'*b* only pass through the concavities 11*a* and 11*b* at the front and rear ends of the end cap 8*a*.

The roller spindle 24 can be rotated by means of an eyelet 9 via a first gear unit 14 (FIGS. 2 and 3A) forming part of the end cap 8*a*. This first gear unit 14 has an output shaft which is formed with a square section and installed in a first housing 49*a* and 50*a*. A second gear unit in a housing 49*b* and 50*b*, which is preferably of identical construction to the first housing 49*a* and 50*a*, is provided in the end cap 8*b* at the right end of the protective enclosure (not shown). No gear unit is provided in the end cap 8*b* at the right end of the awning assembly 1, but a gear unit similar to the first gear unit 14 in the end cap 8*a* can be provided in the end cap 8*b*.

Figure 3A:
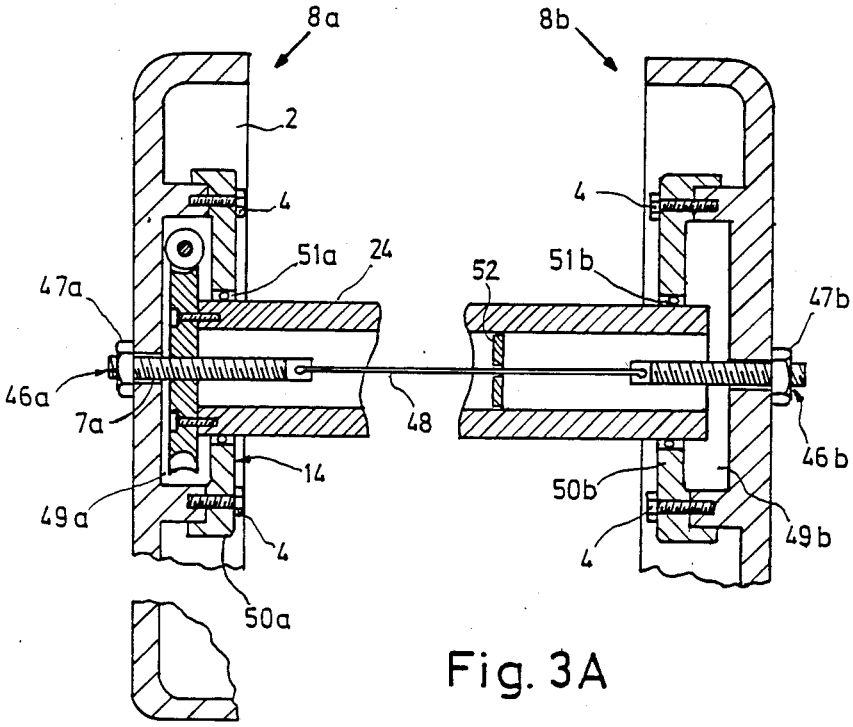
FIG. 3A is a schematic sectional plan view of part of the roller screen according to a modified version (second embodiment) of the first embodiment, analogous to a view taken across the Section A'—A' in FIG. 2.
Figure 3:
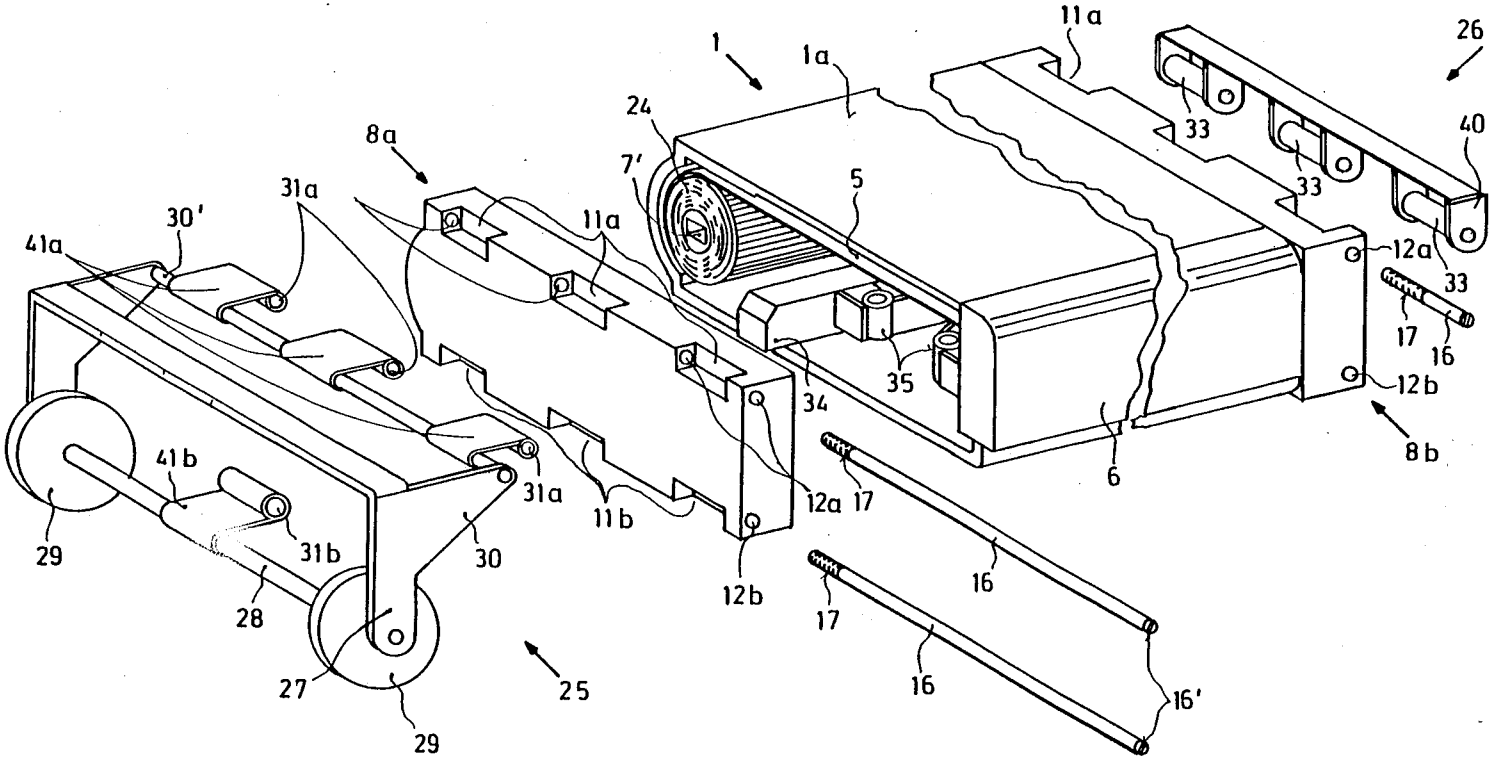
FIG. 3 is an exploded, schematic, perspective view of the screen assembly shown in FIG. 1, together with two different support brackets at opposite ends of the screen assembly.

In the modified embodiment shown in FIG. 3A, the opposite ends of the roller spindle 24 are mounted in bearings 51*a* and 51*b* provided in the removable second part 50*a* and 50*b* of the first housings in the two end caps 8*a* and 8*b*.

To secure the end caps 8*a* and 8*b* to the remainder of the protective enclosure 1*a*, a tie element 48, e.g. a wire cable, extends through the roller spindle 24, as shown in FIG. 3A. The tie element 48 is connected at its opposite ends to screw threaded studs 46*a* and 46*b* which engage nuts 47*a* and 47*b* respectively bearing on the outer surfaces of the end caps 8*a* and 8*b*. The stud and nut combinations 46*a*, 47*a* and 46*b*, 47*b* at opposite ends of the awning assembly therefore constitute anchoring and tensioning means. On the other hand, it is clear that although the tie element 48 must be anchored at both ends to the end caps 8*a* and 8*b*, only one of these anchoring means need be adjustable so as to serve also as tensioning means. As shown in FIG. 3A, the tie element 48 is centered within the roller spindle 24 by means of at least one spacing disc 52. This helps to limit loading on the roller spindle 24, and thus excessive bending, when long and thin roller spindles 24 are employed. For more rigid rollers spindles 24, spacing discs 52 are not required.

Although, in the modified embodiment of the roller awning shown in FIG. 3A, the tie element 48 extends through the roller spindle 24, an analogously arranged tie element may extend, instead, through the mounting tube 34 of the first embodiment illustrated in FIG. 1, 2 and 3.

Figure 2A:
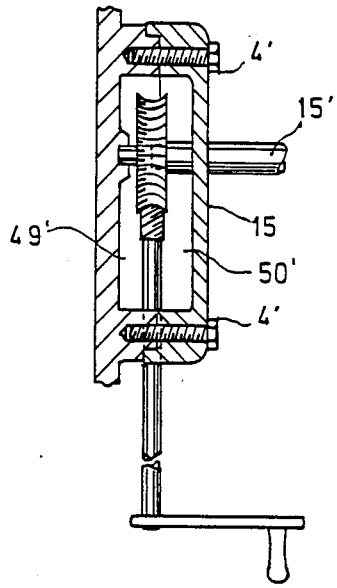
FIG. 2A is a sectional end elevation of part of the roller screen according to the first embodiment, taken across the Section A—A in FIG. 2.

When unwinding of the awning canopy 5 is started by rotating the eyelet 9, the tiltable hinge joints, by which the articulated arms 35 are attached to the mounting tube 34, tilt in known manner, under the weight of the articulated arms 35 and the drop rod 6, when the awning canopy has been unwound sufficiently to exert the necessary leverage on the tiltable hinge joints. The angle of tilt is adjustable by means of a tilt limitor (not shown) which controls each of the tiltable hinge joints by which the articulated arms 35 are attached to the mounting tube 34. The tilt limitor is operated by rotating an eyelet 10 which is attached to a second gear unit 15 (FIGS. 2 and 2A). As shown in FIG. 2A, the second gear unit 15 has a second housing 49' and 50' comprising a first integral part 49' of the end cap 8*a* and a removable second part 50' which is attached to the integral first part 49' by means of set screws 4'. The second gear unit 15 comprises a driving gear which is connected to the eyelet 10 and a driving gear which is driven by the driving gear, the driven gear being connected to an operating shaft 15' extending parallel to the roller spindle 24 for operating each tilt limitor. Details of this mechanism are known and are disclosed, for example, in German patent No. 3,206,963.

The roller awning 1 may be provided with one or more support brackets 25, as shown in FIG. 3. Limbs 27 at opposite ends of the support bracket 25 support an axle shaft 28 carrying two wheels 29. A sleeve 31*b* and an arm 41*b*, by which the sleeve 31*b* is attached to the axle shaft 28, form a lug which can be inserted in the middle concavity 11*b* so as to be connected to the end cap 8*a* by means of the pivot pin 16 which passes through the bores 12*b* and the sleeve 31*b*, Similarly, limbs 30 at opposite ends of the support bracket support a transverse rod 30'. Three sleeves 31*a* and three arms 41*a*, by which the sleeves 31*a* are attached to the transverse rod 30', form lugs which can be inserted in the three concavities 11*a* so as to be connected to the end cap 8*a* by means of the pivot pin 16 which passes through the bores 12*a* and the sleeves 31*a*. The support bracket 25 thus forms a carriage which can be firmly and releasably attached to the awning assembly by means of the pivot pins 16 and which can be rolled along the ground on wheels 29.

Balls or skids may also be fitted to the carriage instead of the wheels 29. In the case of relatively heavy awning assemblies, support brackets 25 may be provided at both ends to facilitate transport.

The roller awning 1 may also be provided with one or more support brackets 26, as shown in FIG. 3. Thus, three sleeves 33 and three pairs of arms 40, by which the sleeves 33 are attached to a common support member, form connecting lugs which can be inserted in the three concavities 11*a* formed in the end cap 8*b* so as to be connected to the end cap 8*b* by means of the pivot pin 16 which passes through the bores 12*a* in end cap 8*b* and through the sleeves 33.

After unloading the awning assembly 1 from a delivery vehicle, a support bracket 25 in the form of a carriage may be attached to the end cap at one end (e.g. the left end) of the awning assembly 1 and a support bracket 26 may be attached to the end cap at the other end (e.g. the right end) of the awning assembly 1. The bracket 26 has the advantage that it can be gripped with both hands. This is also the case with support bracket 25 which can serve as a handle.

With the aid of a support bracket 25, which forms a carriage, the awning assembly 1 can be transported over long distances in the manner of a wheel barrow. The support 25 can also facilitate the hoisting of an awning assembly 1 at a vertical support surface to which the roller awning is to be attached. When the awning assembly 1 is fitted with a load-bearing element such as the mounting tube 34 shown in FIG. 3, the mounting bracket 25 may be connected to this load-bearing element.

Figure 4:
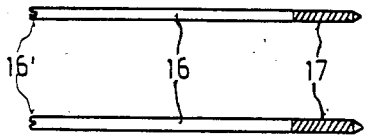
FIG. 4 is an exploded schematic end elevation of the first embodiment, illustrating how this embodiment is mounted on a support surface.

To mount the roller awning shown in FIG. 2, the support bracket 18 for the end cap 8*b* is first attached to a support surface 20, as shown in FIG. 4, by conventional means (not shown). The right end of the awning assembly 1 is then raised with the aid of a support bracket, such as the support bracket 26 shown in FIG. 3, until one of the bores 12 is aligned with one of the internally screw-threaded apertures 19 formed in the support bracket 18.

The pivot pin 16 which has previously been inserted in the bore 12 can then be pushed through the end cap 8*b* into engagement with the support bracket 18 and screwed into position by means of a turning tool engaging driving means 16' at the outer end of the pivot pin 16.

A support bracket 18 for the end cap 8*a* is attached to the suppport surface 20. If the end cap 8*a* at the left end of the awning assembly 1 is fitted with a support bracket 25, in the form of a carriage, this is removed and, if necessary, the left end of the awning assembly 1 is raised until the bores 12*a* and 12*b* in the end cap 8*a* are aligned with internally threaded pivot pin apertures 19 formed in the support bracket 18 for the end cap 8*a*. Pivot pins 16 are then passed through the bores 12*a* and 12*b* and screwed into the pivot pin apertures 19 to secure the end cap 8*a* in place.

Lifting of the left end of the awning assembly 1 may be effected by means of a support bracket 26, in the form of a handle. In this case, the awning assembly 1 pivots about the pivot pin 16 already connecting the end cap 8*b* to the support bracket 18 at the right end of the roller awning 1. The second pivot pin 16 in the end cap 8*b* can then be screwed into the other pivot pin aperture 19 in the support bracket 18 at the right end of the roller awning 1.

If, due to its weight, the awning assembly 1 cannot be lifted by hand, it is expedient to make use of a pulley block which can be attached to one of the end caps 8*a* or 8*b* by means of the pivot pin 16 passing through the bores 12*b*. The connection can be effected by means of a support bracket 26 with sleeves 33 which engage a pivot pin 16 at the end of the awning assembly 1 to be lifted first.

Figure 5:
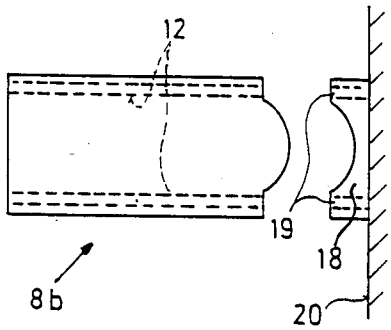
FIGS. 5, 6 and 7 are schematic elevational views of third, fourth and fifth embodiments of the invention respectively, FIGS. 5 and 7 being end views and FIG. 6 being a front view.
Figure 5:
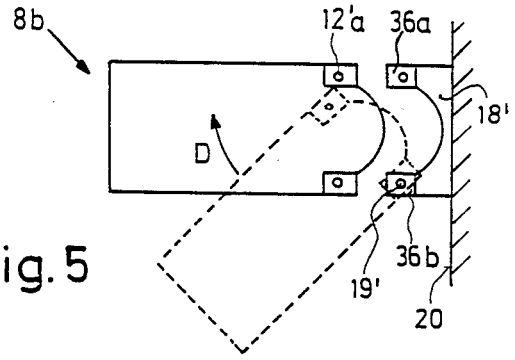

In the embodiment of the invention schematically illustrated in FIG. 5, the roller awning has support brackets 18', which are attached to a support surface 20 by conventional means (not shown). Each support bracket 18' has two legs 36*a* and 36*b* with transverse pivot-pin apertures 19'. After the awning assembly has been lifted to the level of the support brackets 18', the bores 12'*b* adjacent the inner surfaces of the end cap 8*a* and 8*b* are aligned with the pivot pin apertures 19' in the lower lugs 36*b*. Pivot pins (not shown) are then inserted and secured in the aligned bores 12'*b* and the pivot pin apertures 19' to effect hinged connection. During this operation, the awning assembly is tilted downwardly, as indicated in broken outline, and can be supported in this position by a ladder or some other prop. The awning assembly is then swung upwards to permit the awning assembly to be connected in an analogous manner to the upper lugs 36*a* of the brackets 18'. This mounting procedure is advantageous in spatially confined conditions at the mounting location.

Figure 6:
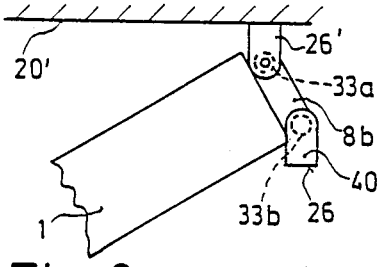

FIG. 6 is a schematic front elevational view of part of a roller awning during attachment of the roller awning to a horizontal support surface 20' such as a ceiling. As shown, a support bracket 26', similar to the support bracket 26 shown in FIG. 3, is attached to the support surface 20' by conventional means (not shown). Another support bracket 26 is connected to the end cap 8*b* by means of a pivot pin (not shown) extending through the bores 12*b* in the end cap 8 (not shown) of the awning assembly 1 to the support surface 20'. When the right end of the awning assembly 1 has been mounted in position, the awning assembly 1 can be rotated about the hinged connection at the right end to raise the left end of the awning assembly 1 which can then be secured in position in an analogous manner.

Figure 7:
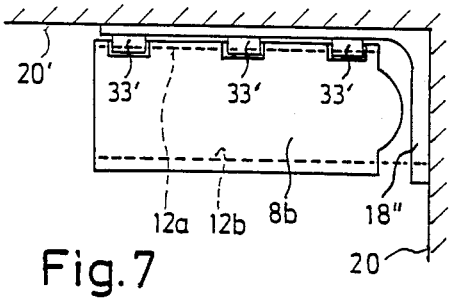

FIG. 7 is a schematic end elevation of a roller awning and shows an end cap 8*b* of an awning assembly attached to an angular support bracket 18''. The angular bracket 18'' is attached to vertical and horizontal support surfaces 20 and 20' by conventional means (not shown) and is provided with three sleeves 33' which are accommodated in the concavities 11*a* of the end cap 8*b* so that these sleeves 33' are aligned with the bores 12*a* in the end cap 8*b* and a pivot pin 16 is passed through the bores 12*a* and the sleeves 33' and secured in position to complete the hinged connection between the end cap 8*b* and the angular bracket 18''. The end cap 8*a* at the left end of the awning assembly is mounted in an analogous manner after it has been raised into position by rotating the awning assembly about the hinged connection between the end cap 8*b* and the angular bracket 18''.

Figure 8A:
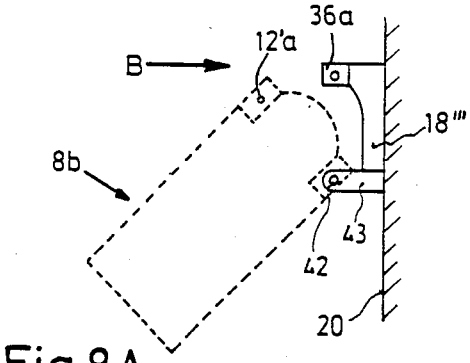
FIGS. 8A and 8B are respectively a schematic and a partial front elevation of a sixth embodiment of the invention.
Figure 8B:
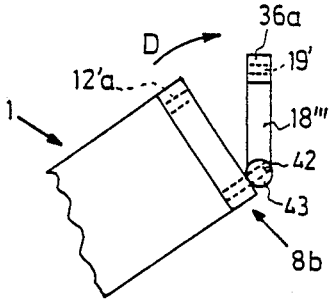

FIGS. 8A and 8B show a further embodiment of an arrangement and method of mounting one end of the awning assembly by means of a hinged connection and then raising the other end, by rotating the awning assembly about the hinged connection, prior to securing the other end in position, as already described with reference to FIG. 4, 6 and 7.

As shown in FIGS. 8A and 8B, a support bracket 18''' for the end cap 8*b* at the right end of an awning assembly 1 is attached to a support surface 20 by conventional means (not shown). The support bracket 18''' has a connecting lug 36*a* (similar to the connecting lug 36*a* described with reference to FIG. 5) with a transversely extending pivot pin aperture 19' for alignment with the bores 12'*a* in the end cap 8*b*. The support bracket 18''' is also provided with a pin 43 which projects perpendicularly from the support surface 20 and is rotatable about its longitudinal axis. A pivot pin aperture 42 is formed in the pin 43 for alignment with the bores 12'*b* in the end cap 8*b*.

To mount the awning assembly 1, the right end is raised until the end cap 8*b* is next to the support bracket 18''', as shown in FIG. 8B. The awning assembly 1 is tilted downwardly, as shown in FIG. 8A, in the same manner as the awning assembly shown in FIG. 5. The pin 43 is then rotated until the pivot pin aperture 42 is suitably inclined for alignment with the bore 12'*b* in the end cap 8*b*. This alignment is then effected and a pivot pin (not shown) is inserted in the bore 12'*b* and the pivot pin aperture 42 and secured in position. The awning assembly 1 is then rotated about the pivot pin until the axes of the bore 12'*a* in the end cap 8*b* and the pivot pin aperture 19' in the lug 36*a* lie in the same vertical plane. The left end of the awning assembly 1 is then raised into position by rotating the awning assembly with the pin 43. The bore 12'*a* is thus brought into alignment with the pivot pin aperture 19' and a pivot pin is inserted and secured in place in the bore 12'*a* and in the pivot pin aperture 19' to complete attachment of the end cap 8*b* to the support bracket 18'''. The left end of the awning assembly can then be secured in position by appropriate means.

Figure 9:
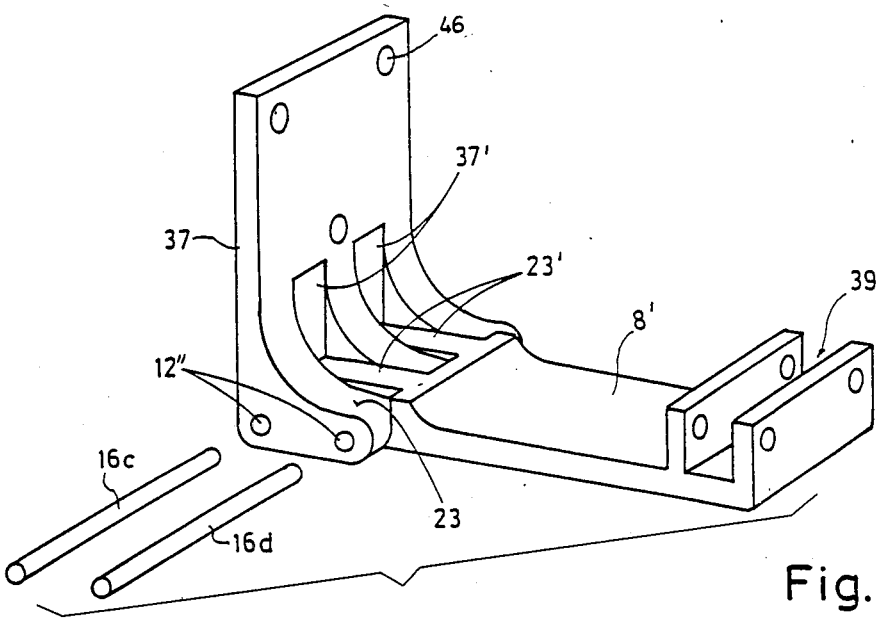
FIG. 9 is a perspective view of a support bracket and co-operating hinge member forming part of a seventh embodiment of the invention.

As shown in FIG. 9, a hinge member 8' provided with a channel 39 for receiving and gripping the mounting tube 34 of an awning assembly is attached to a support bracket 37 which is formed with apertures 46 for attachment to a support surface (not shown). The support bracket 37 and the hinge member 8' are provided with sturdy, intermeshing fingers 23 and 23'. Bores (not shown) in the fingers 23' of the hinge member 8' are aligned with pivot pin apertures 12'' formed in the fingers 23 of the support bracket 37 and pivot pins 16*c* and 16*d* are inserted in the pivot pin apertures 12'' and the bores in the fingers 23' of the hinge member 8'. In practice, an awning assembly incorporating the hinge member 8' is raised into horizontal alignment with the support bracket 37 and the fingers 23' on the hinge member 8' are inserted between the fingers 23 of the support bracket 37. Bores in the fingers 23' of the hinge member 8' are then aligned with pivot pin apertures 12" for the reception of one of the pivot pins 16c and 16d, preferably pivot pin 16c. This pivot pin is then inserted and the hinge member 8' is rotated about this pivot pin until the other bores formed in the fingers 23' of the hinge member 8' are aligned with the other pivot pin apertures 12' in the fingers 23 formed in the support bracket 37 and the other pivot pin is inserted to complete the attachment of the hinge member 8' to the support bracket 37.

Where the fingers 23' of the support bracket 8' are long enough to abut against the undersides of portions 37' between the fingers 23 of the support bracket 37, the inner pivot pin 16c can be omitted, together with the pivot pin apertures 12" and bores in fingers 23' for reception of this pivot pin 16c. However, to obtain a secure connection, it is preferred to provide this connection with two pivot pins 16c and 16d, as shown in FIG. 9.

Although the roller awning may be provided at both ends with end caps 8a and 8b, as described with reference to FIGS. 1 to 3, for attachment to appropriate support brackets, one or more hinge members 8' and support brackets 37, as described with reference to FIG. 9, may also be provided between the two ends of the roller awning to improve the connection of the roller awning to a support surface. This is important with very wide awnings and with awnings which must be attached to weak mounting bases such as tiles, hollow bricks, wood, aerated concrete and layers of thermal insulation. In this case attachment of the roller awning at only two positions, such as at its opposite ends, is often inadequate.

Figure 10:
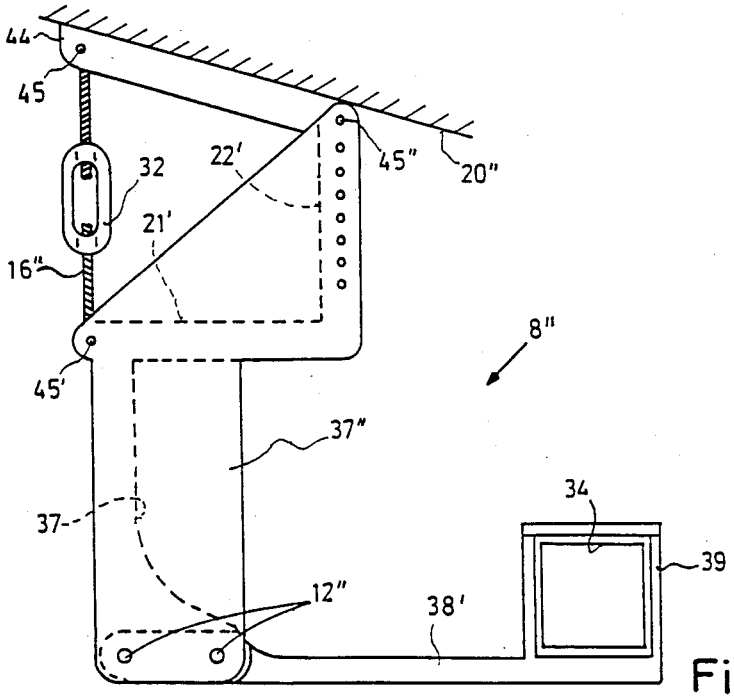
FIG. 10 is a side elevation of an adjustable support bracket and a hinge member forming part of an eighth embodiment of the invention, for mounting a roller screen according to the invention on an inclined support surface.

As shown in FIG. 10, a hinge member 8" (similar to the hinge member 8' shown in FIG. 9) and a support bracket 37" incorporating a portion 37 similar to the support bracket 37 shown in FIG. 9 are interconnected by two pivot pins (not shown) in the same manner as the hinge member 8' and support bracket 37 shown in FIG. 9.

The support bracket 37" comprises a rafter bracket 44 for attachment to a rafter 20" by conventional means (not shown) and a triangular portion formed with reinforcing ribs 21' and 22'. A turnbuckle comprising a bracket 32 and two opposite-handed screw members 16" extends between pivot pins (not shown) mounted in apertures 45 and 45' formed respectively in the rafter bracket 44 and the reinforcing rib 21'. Connection between the rafter bracket 44 and the triangular portion of the bracket 37" is effected by a hinge pin (not shown) which is inserted in one of a series of apertures 45" formed in the reinforcing rib 22' and in an aperture (not shown) formed in the rafter bracket 44. The inclination of the portion 38' of the hinge member 8", relative to the rafter 20", can be controlled by adjustment by of the turnbuckle 16" and 32 at one end of the rafter bracket 44 and by inserting the hinge pin at the other end of the rafter bracket 44 through different apertures 45" in the reinforcing rib 22'.

As shown in FIG. 10, the channel 39 of the hinge member 8" accommodates a mounting tube 34 of an awning assembly and so the hinge member 8" may be used to attach an awning assembly to a support bracket 37" disposed between the ends of the awning assembly in the same manner as the hinge member 8' described with reference to FIG. 9.

The invention is not limited to the constructions illustrated in the accompanying drawings. Thus, for example:

the roller screen may be provided with a hinge member in the form of an end cap having reinforcing ribs which, without having bores, can be inserted and possibly even snapped into recesses in the support bracket;

where an end cap for an awning assembly incorporates first and second gear units 14 and 15, as described with reference to FIGS. 2A and 3A, and the first part of the housing for each such gear unit 14 and 15 is an integral part of the end cap, the second part of both housings may be a common cover which is removably attached to the first housing parts of the two housings to protect the two gear units 14 and 15 from damage and/or contamination; and a compressed air line can be attached to the hinge member of a roller awning according to the invention for the purpose of blowing material of the awning canopy and/or for drying the awning cavity and a vacuum line can be attached to the hinge member for the purpose of such cleaning of the awning canopy.

I claim:

1. A roller screen comprising:
a sheet of pliable material;
a roller spindle on which the sheet of pliable material can be rolled;
at least one hinge member supporting the roller spindle;
first pivot means supported by the hinge member and extending along at least one of two rectilinear axes respectively extending parallel to the roller spindle and laterally in a plane which is perpendicular to the roller spindle; and
at least one support bracket formed with second pivot means which are pivotally cooperable with the first pivot means, during attachment of the roller screen to the support surface, so as to permit pivotal movement between the hinge member and the support bracket.

2. A roller screen, according to claim 1, wherein one or more bores are formed in the hinge member along at least one of the two rectilinear axes; the first pivot means comprising a pivot pin which extends through at least one of said bores; and the second pivot means comprising a pivot pin aperture for receiving and supporting the pivot pin so that the hinge member and the support bracket are hingedly connected.

3. A roller screen, according to claim 2, wherein the hinge member is an end cap which has at least one substantially straight external edge extending along an edge axis lying in a plane which is perpendicular to the axis of the roller spindle, a reinforcing rib extending longitudinally along said edge axis, and said two rectilinear axes extending respectively along and transversely of said reinforcing rib.

4. A roller screen, comprising
a sheet of pliable material;
a roller spindle on which the sheet of pliable material can be rolled;
at least one hinge member supporting the roller spindle;
first pivot means supported by the hinge member and extending along at least one of two rectilinear axes, respectively extending parallel to the roller spindle and laterally in a plane which is perpendicular to the roller spindle;

at least one support bracket formed with second pivot means which are cooperable with the first pivot means, during attachment of the roller screen to the support surface, so as to permit pivotal movement between the hinge member and the support bracket; wherein one or more bores are formed in the hinge member along at least one of the two rectilinear axes; the first pivot means comprising a pivot pin which extends through at least one of said bores; and the second pivot means comprising a pivot pin aperture for receiving and supporting the pivot pin so that the hinge member and the support bracket are hingedly connected;

the hinge member is an end cap which has at least one substantially straight external edge extending along an edge axis lying in a plane which is perpendicular to the axis of the roller spindle, a reinforcing rib extending longitudinally along said edge axis, and said two rectilinear axes extending respectively along and transversely of said reinforcing rib; and the end cap has adjacent portions respectively formed with said substantially straight external edge and at least one further substantially straight external edge which extends along said edge axis, a concavity being formed in the end cap, between at least one pair of adjacent portions, the support bracket being provided with at least one connecting lug which is disposed within the concavity, the pivot pin aperture extending through the connecting lug, and the pivot pin extending through said adjacent portions and said connecting lug along a rectilinear axis which is parallel to the edge axis.

5. A roller screen, according to claim 4, wherin each connecting lug comprises at least one arm and a sleeve supported by said arm and wherein that sleeve has a bore constituting at least part of the pivot pin aperture.

6. A roller screen, according to claim 3, wherein the pivot pin aperture and the pivot pin are formed, respectively, with cooperating internal and external screw threads for securing the pivot pin in position.

7. A roller screen, comprising a sheet of pliable material;

a roller spindle on which the sheet of pliable material can be rolled;

at least one hinge member supporting the roller spindle;

first pivot means supported by the hinge member and extending along at least one of two rectilinear axes, respectively extending parallel to the roller spindle and laterally in a plane which is perpendicular to the roller spindle;

at least one support bracket formed with second pivot means which are cooperable with the first pivot means, during attachment of the roller screen to the support surface, so as to permit pivotal movement between the hinge member and the support bracket; wherein one or more bores are formed in the hinge member along at least one of the two rectilinear axes; the first pivot means comprising a pivot pin which extends through at least one of said bores; and the second pivot means comprising a pivot pin aperture for receiving and supporting the pivot pin so that the hinge member and the support bracket are hingedly connected;

the hinge member is an end cap which has at least one substantially straight external edge extending along an edge axis lying in a plane which is perpendicular to the axis of the roller spindle, a reinforcing rib extending longitudinally along said edge axis, and said two rectilinear axes extending respectively along and transversely of said reinforcing rib; and the end cap comprises first gear means for assisting in rolling the sheet of pliable material onto and off of the roller spindle.

8. A roller screen, according to claim 7, wherein a first housing encloses the first gear means and has a first part, formed integral with the end cap, and a second part which is removably attached to the first part of the second housing.

9. A roller screen, comprising a sheet of pliable material;

a roller spindle on which the sheet of pliable material can be rolled;

at least one hinge member supporting the roller spindle;

first pivot means supported by the hinge member and extending along at least one of two rectilinear axes, respectively extending parallel to the roller spindle and laterally in a plane which is perpendicular to the roller spindle;

at least one support bracket formed with second pivot means which are cooperable with the first pivot means, during attachment of the roller screen to the support surface, so as to permit pivotal movement between the hinge member and the support bracket; wherein one or more bores are formed in the hinge member along at least one of the two rectilinesr axes; the first pivot means comprising a pivot pin which extends through at least one of said bores; and the second pivot means comprising a pivot pin aperture for receiving and supporting the pivot pin so that the hing emember and the support bracket are hingedly connected;

the hinge member is an end cap which has at least one substantially straight external edge extending along an edge axis lying in a plane which is perpendicular to the axis of the roller spindle, a reinforcing rib extending longitudinally along said edge axis, and said two rectilinear axes extending respectively along and transversely of said reinforcing rib; and further comprising two end caps disposed at opposite ends of the roller spindle and providing bearing supports for the roller spindle, at least one tie element connected to both end caps and extending through the roller spindle, and tensioning means provided at at least one of the end caps for tensioning the tie element.

10. A roller screen, comprising a sheet of pliable material;

a roller spindle on which the sheet of pliable material can be rolled;

at least one hinge member supporting the roller spindle; and first pivot means supported by the hinge member and extending along at least one of two rectilinear axes, respectively extending parallel to the roller spindle and laterally in a plane which is perpendicular to the roller spindle;

at least one support bracket formed with second pivot means which are cooperable with the first pivot means, during attachment of the roller screen to the support surface, so as to permit pivotal movement between the hinge member and the support bracket; wherein one or more bores are formed in the hinge member along at least one of the two rectilinear axes; the first pivot means comprising a pivot pin which extends through at least one of said bores; and the second pivot means comprising a pivot pin aperture for receiving and supporting the pivot pin so that the hinge member and the support bracket are hingedly connected;

the hinge member is an end cap which has at least one substantially straight external edge extending along an edge axis lying in a plane which is perpendicular to the axis of the roller spindle, a reinforing rib extending longitudinally along said edge axis, and said two rectilinear axes extending respectively along and transversely of said reinforcing rib; and further comprising a mounting tube extending parallel to the roller spindle and at least two articulated arms fastened to the mounting tube for supporting the pliable material when it is unrolled from the roller spindle, wherein the end cap is formed with a reinforcing rib which constitutes a support for one end of the mouting tube.

11. A roller screen, according to claim 10, comprising two end caps disposed at opposite ends of the roller spindle and providing bearing supports for the roller spindle, at least one tie element connected to both end caps means provided at at least one of the end caps for tensioning the tie element.

12. A roller screen, according to claim 10, wherein the end cap comprises second gear means and adjustment means driven by the second gear means for limting the angle of tilt of one of the articulated arms.

13. A roller screen, according to claim 12, wherein a second housing encloses the second gear means and has a first part, formed it integral with the end cap, and a second part which is removably attached to the first part of the second housing.

14. A roller screen comprising:

a sheet of pliable material;

a roller spindle, which has an axis defining a horizontal direction, on which the sheet of pliable material can be rolled;

at least one end support member supporting the roller spindle at an end thereof;

first pivot means in the end support member for pivoting said roller spindle about at least a predetermined one of two rectilinear axes, said two rectilinear axes respectively extending parallel to the roller spindle, and laterally in a plane which is perpendicular to the roller spindle; and at least one support bracket means for connecting to a support surface, said support bracket means being releasably cnnectable to said end support member by second pivot means which pivotally engage the first pivot means, during attachment of the end support member and the roller screen to the support surface, with only one said end support member so attached, for permitting pivotal movement between the end support member and the support bracket, and thereby permitting movement of the end support member and the roller screen about said predetermined axis.

15. A roller screen, according to claim 14, wherein one or more bores are formed in the end support member along at least said predetermined one of the two rectilinear axes; the first pivot means comprising a pivot pin which extends through at least one of said bores; and the second pivot means comprising a pivot pin aperture for receiving end supporting the pivot pin so that the hinge member and the support bracket are hingedly connected.

16. A roller screen, according to claim 15, wherein the end support member is an end cap which has at least one substantially straight external edge lying in a plane which is perpendicular to the axis of the roller spindle, a reinforcing rib extending longitudinally along said edge, and said two rectilinear axes extending respectively along and transversely of said reinforcing rib.

17. A roller screen, according to claim 16, wherein the pivot pin aperture and the pivot pin are formed, respectively, with the cooperating internal and external screw threads for securing the pivot pin in position.

* * * * *